US005321200A

United States Patent [19]

Yamamoto

[11] Patent Number: 5,321,200

[45] Date of Patent: Jun. 14, 1994

[54] DATA RECORDING SYSTEM WITH MIDI SIGNAL CHANNELS AND REPRODUCTION APPARATUS THEREFORE

[75] Inventor: Yuji Yamamoto, Yawata, Japan

[73] Assignee: Sanyo Electric Co., Ltd., Osaka, Japan

[21] Appl. No.: 845,141

[22] Filed: Mar. 3, 1992

[30] Foreign Application Priority Data

Mar. 4, 1991 [JP] Japan ..... 3-37448

[51] Int. Cl.[5] ..... G10H 7/00

[52] U.S. Cl. ..... 84/645; 84/601

[58] Field of Search ..... 84/600, 645, 601

[56] References Cited

U.S. PATENT DOCUMENTS

| | | | |
|---|---|---|---|
| 5,027,689 | 7/1991 | Fujimori | 84/622 |
| 5,046,004 | 9/1991 | Tsumura et al. | 364/419 |
| 5,048,390 | 9/1991 | Adachi et al. | 84/464 R |
| 5,127,303 | 7/1992 | Tsumura et al. | 84/645 X |
| 5,131,311 | 7/1992 | Murakami et al. | 84/609 |
| 5,146,833 | 9/1992 | Lui | 84/462 |
| 5,159,143 | 10/1992 | Emi et al. | 84/645 |
| 5,194,682 | 3/1993 | Okamura et al. | 84/625 |
| 5,194,683 | 3/1993 | Tsumura et al. | 84/645 |
| 5,208,413 | 5/1993 | Tsumura et al. | 84/615 |
| 5,208,421 | 5/1993 | Lisle et al. | 84/645 |
| 5,225,618 | 7/1993 | Wadhams | 84/602 |
| 5,247,126 | 9/1993 | Okamura et al. | 84/645 X |
| 5,250,747 | 10/1993 | Tsumura | 84/645 |

*Primary Examiner*—William M. Shoop, Jr.
*Assistant Examiner*—Jeffrey W. Donels
*Attorney, Agent, or Firm*—Armstrong, Westerman, Hattori, McLeland & Naughton

[57] ABSTRACT

A magnetic disc 13 serving as a memory medium has stored therein sound control MIDI messages and MIDI messages containing character codes so as to make it possible to reproduce performance data and image data over a prolonged period of time although the memory medium has a given capacity. A MIDI sequencer 14 delivers the MIDI messages serially based on the signals read from the disc 13. A sound source device 15 performs specified music by being controlled by the sound source control MIDI messages. An image forming device 20 displays a text on a display 21 based on the MIDI messages containing the character codes.

6 Claims, 7 Drawing Sheets

| | | Status | Data 1 | Data 2 |
|---|---|---|---|---|
| (a) | Note On | "9 X h" | Note Number | Velocity |
| (b) | Note Off | "8 X h" | Note Number | Velocity |

DATA RECORDING SYSTEM WITH MIDI SIGNAL CHANNELS AND REPRODUCTION APPARATUS THEREFORE

FIELD OF THE INVENTION

The present invention relates to memory media having stored therein signals (MIDI signals) according to MIDI (Musical Instrument Digital Interface) standard which is adopted worldwide generally for the communication control of sound source devices for keyboards or like musical instruments and also to a reproduction apparatus for the memory media. More particularly, the invention relates to memory media having stored therein image data for showing the images of characters or the like on a display in addition to the performance data to be fed to the sound source device, and a reproduction apparatus for simultaneously reading the performance data and the image data from the memory medium

BACKGROUND OF THE INVENTION

The method of data communication according to the MIDI standard is an asynchronous serial communication method as prescribed in "MIDI 1.0 DETAILED SPECIFICATION DOCUMENT VERSION 4.0," and the data transfer rate used in this method is 31.25 kbit/sec. When one byte (8 bits) of data is to be transferred, one start bit and one stop bit are added thereto, and the data therefore comprises 10 bits in its entirety.

In the data communication according to the MIDI standard, data is handled in the unit of "messages" comprising a plurality of bytes. With reference to FIG. 7, these messages are divided generally into channel messages and system messages, which are further classified into different types of messages, i.e., five types in total. The messages of these types include a channel voice message, channel mode message and system common message each comprising one status byte, and one or two data bytes led by the status.

According to the MIDI standard, up to 16 channels are settable. The status byte includes channel number data indicating a particular channel to which the message is directed. Utilizing the concept of the MIDI channels, therefore, for example 16 musical instruments are individually controllable independently through a single MIDI cable.

The channel voice message shown in FIG. 7 is further classified according to the function as shown in FIG. 8. The note on message included in the classified messages corresponds to "production of sound" which is the most essential of all items of performance data. As seen in FIG. 9 (*a*), this message is composed of the status byte "9Xh" (wherein h is a symbol indicating that hexadecimal notation is used, and X is a hexadecimal number representing a particular MIDI signal channel and is one of the values 0 to F), and two bytes of data subsequent to the status byte. The first data byte is termed "note number" for controlling the musical interval. The second data byte is called "velocity" for controlling the sound volume.

On the other hand, the note off message corresponds to "cessation of sound" and is composed of the status byte "8Xh" and two bytes of data subsequent thereto as shown in FIG. 9(*b*). Incidentally, the note on message and the note off message are paired, and a pair of note on and note off messages are identical in note number.

The sound source device to be controlled by MIDI signals starts to produce a sound with specified musical interval, sound volume and tone color in response to one message, and ceases producing the sound in response to another message thereafter given. In the simplest case, therefore, a specified sound can be continuously produced from the device only for a predetermined period of time by intermittently feeding to the device a message specifying particular musical interval, sound volume and tone color, a message for starting sound production and a message for ceasing the sound production, each at a predetermined time.

In the case where the specified sound is to be produced only for the predetermined period of time with MIDI signals, sound signals need not be continuously given over the period of sound production unlike the sound reproduction by audio tape recorders or the like but MIDI signals need only to be fed to the sound source device intermittently, so that the specified sound can be produced with a greatly reduced amount of data.

Incidentally, MIDI signals are usually stored in a medium in a format adapted for computer communication together with timing data for controlling the output timing of messages.

In recent years, so-called "KARAOKE" apparatus have found wide household and business uses for enjoying singing songs to the accompaniment of music reproduced from disc recording media.

Video disc players having a sound mixing function are conventionally utilized as such KARAOKE apparatus. The sound signal of an accompaniment reproduced from a video disc and the sound signal of a song input from a microphone are mixed together to release the resulting sound from a speaker. Further the images of the corresponding text reproduced from the video disc are projected one after another on the screen of a display in synchronism with the reproduction of sound signal of the accompaniment.

Video discs for KARAOKE each have stored therein a plurality of musical compositions or tunes. Since the accompaniment sound signal and the text image signal for each tune are recorded at the same time as superposed, a very great amount of data is stored for each tune. For this reason, the number of tunes which can be stored in one disc is inevitably much smaller than in other discs, for example, a compact disc wherein the sound signal only is stored.

Accordingly, the conventional KARAOKE apparatus have the drawback of necessitating frequent changes of discs upon request for tunes.

SUMMARY OF THE INVENTION

An object of the present invention is to provide a memory medium having stored therein performance data as to a large number of tunes and image data for displaying the corresponding texts so as to realize a KARAOKE apparatus which does not necessitate very frequent change of media upon request for tunes.

Another object of the invention is to provide a memory medium having stored therein performance data and image data in the form of MIDI signals to thereby reduce the amount of data per tune.

Another object of the invention is to provide a reproduction apparatus for use with a recording medium having stored therein performance data and image data in the form of MIDI signals, the apparatus being adapted to control a sound source device based on the performance data read from the medium for an automatic performance and at the same time, to show the images of a text or the like on a display based on the image data read from the medium.

The present invention provides a memory medium having stored therein performance data as assigned to at least one of MIDI signal channels, and image data relating to the performance data and as assigned to at least one of the other channels according to MIDI standard.

The memory medium embodying the invention has stored therein image data utilizing at least one of MIDI signal channels, so that the amount of data to be stored can be greatly reduced unlike the conventional video disc or the like wherein a video signal and an audio signal are recorded at the same time.

The present invention further provides a reproduction apparatus which comprises signal reading means for reading MIDI signals from the memory medium and delivering the signals, a sound source device for receiving one of the read signals from a channel containing the performance data to produce an audio signal based on the performance data, sound release means for receiving the audio signal, an image forming device for receiving another one of the read signals from a channel containing the image data to produce a video signal based on the image data, and display means for receiving the video signal.

With the reproduction apparatus embodying the invention, the performance data and the image data are retrieved from the memory medium in the form of MIDI signals, so that a MIDI sequencer serving as signal reading means for the conventional medium wherein performance data only is stored can be used as it is as the signal reading means. This simplifies the construction of the apparatus.

DETAILED DESCRIPTION OF EMBODIMENT

The present invention will be described below with reference to an embodiment thereof which is a KARAOKE apparatus.

Memory Medium

First, the format of MIDI signals for use in the memory medium will be described.

Figures 8, 9:
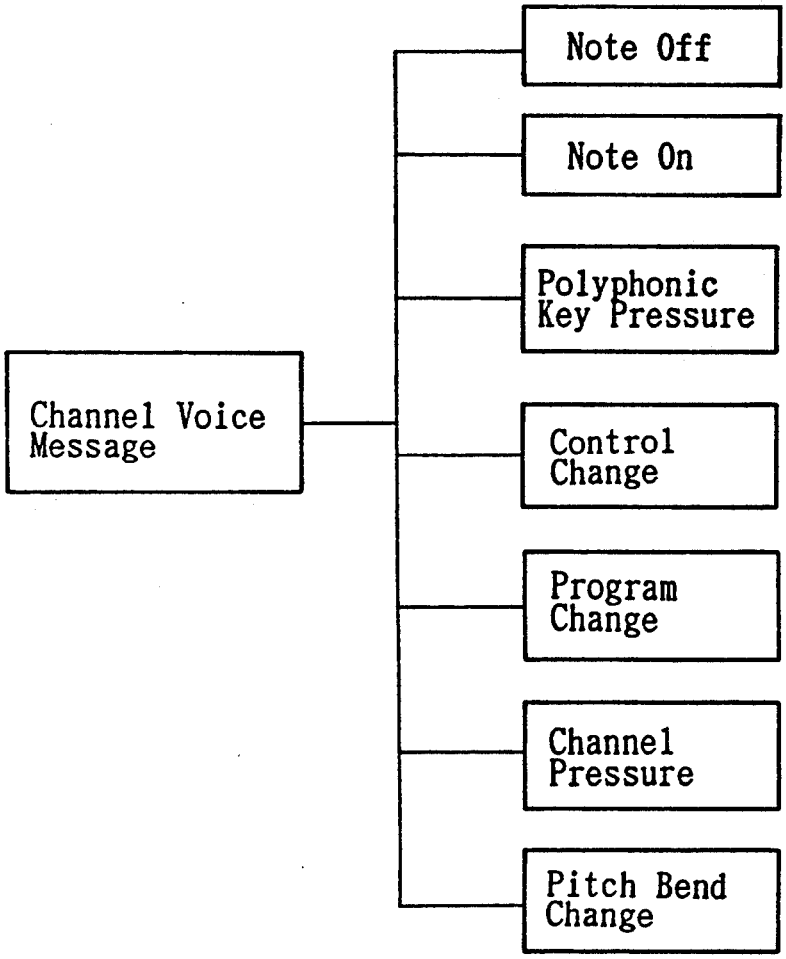
FIG.8 PRIOR ART
FIG.9 PRIOR ART
FIG. 8 is a diagram showing the classification of channel voice messages.
FIG. 9 is a diagram showing the formats of note on and note off messages.

According to the present embodiment, character codes serving as image data are assigned to the data position of the note on message and the note off message shown in FIG. 8 utilizing one of 16 MIDI signal channels.

Usable as character codes are, for example, JIS (Japanese Industrial Standard) codes which are widely used in Japan. In this case, "A" in the alphabet, for example, is represented by 23*h* as an upper byte and 41*h* as a lower byte. The JIS codes include not only characters but also flat, sharp and like symbols or devices. However, JIS is not limitative; also usable are standards empolyed in other countries or optionally determined standards.

Figure 2:
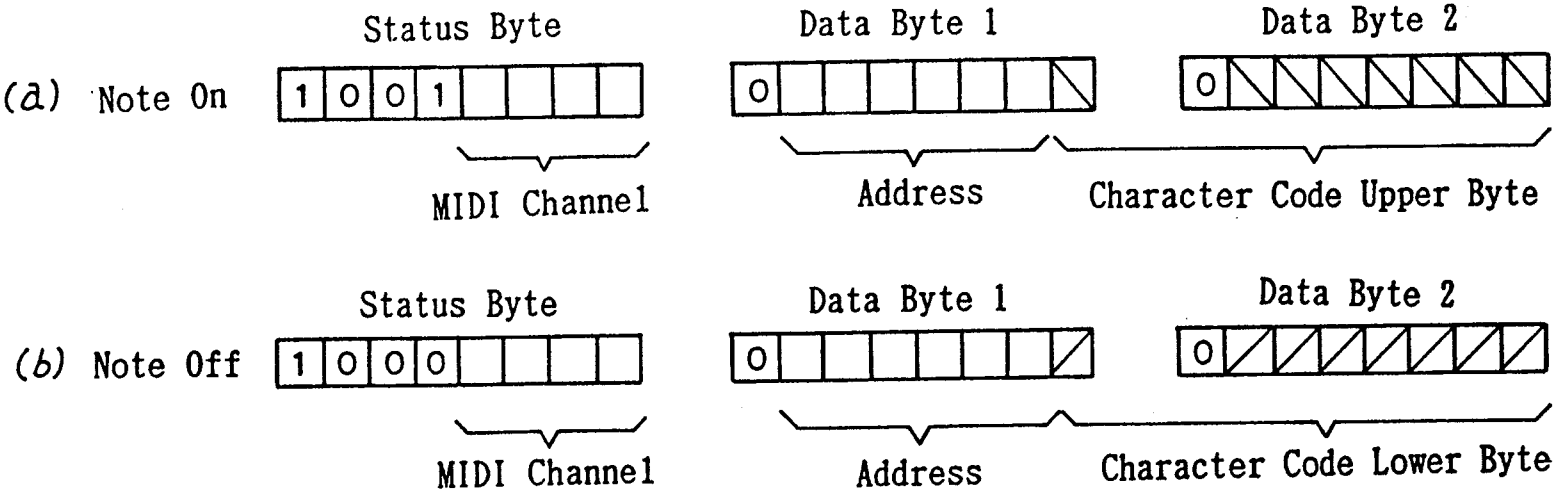
FIG. 2 is a diagram illustrating assignment of image data on a memory medium.

FIG. 2, (*a*) and (*b*), shows assignment of character codes to the note on message and note off message. According to the MIDI standard, MSB of data bytes of the note on message and note off message must invariably be set to 0 to indicate that the byte is a data byte, so that the amount of data which can be stored in one data byte is 7 bits.

Accordingly, the note on message and the note off message are to be respectively assigned the upper byte and the lower byte of the character codes, each at the position of LSB of the data byte 1 and 7 bits of the data byte 2 as combined therewith, i.e., at the position of 8 bits, as illustrated, so as to represent one character with these two messages.

Further assigned to the remaining 5 bits of the data byte 1 is an address which is used when items of character code data are successively written in memories (indicated at 3 and 4 in FIG. 4) for temporarily storing the character code data to be displayed on a screen at a time as will be described later. The positions of characters to be displayed on the screen are determined by such addresses.

Figure 3:
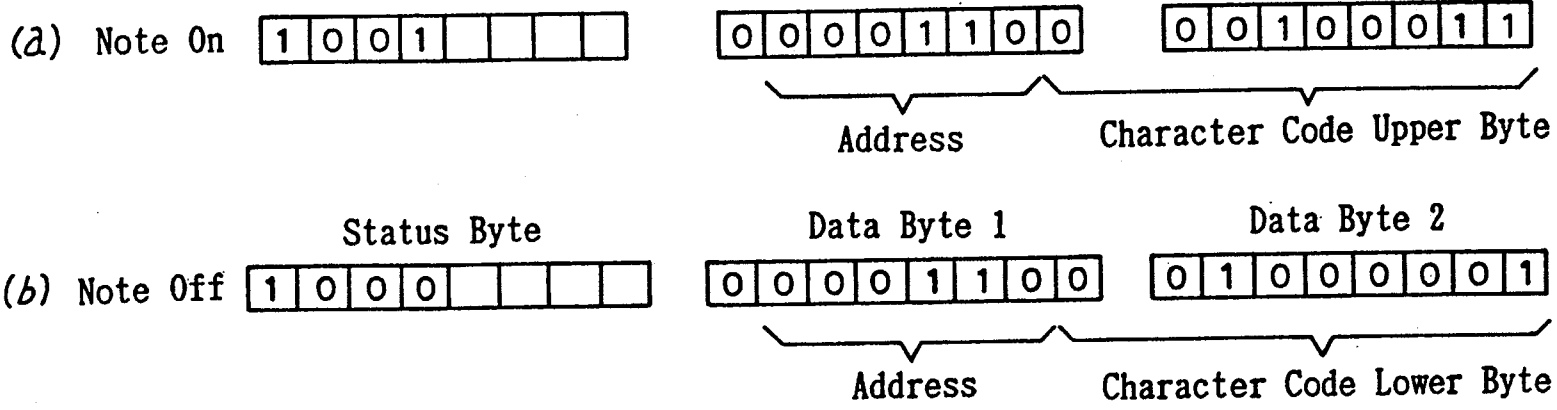
FIG. 3 is a diagram showing assignment of character codes for "A" of the alphabet as image data.

FIG. 3, (*a*) and (*b*), shows the JIS codes "23h" and "41h" representing "A" in the alphabet, as assigned to the data positions of the note on message and the note off message, respectively, along with the address "06h."

Figure 6:
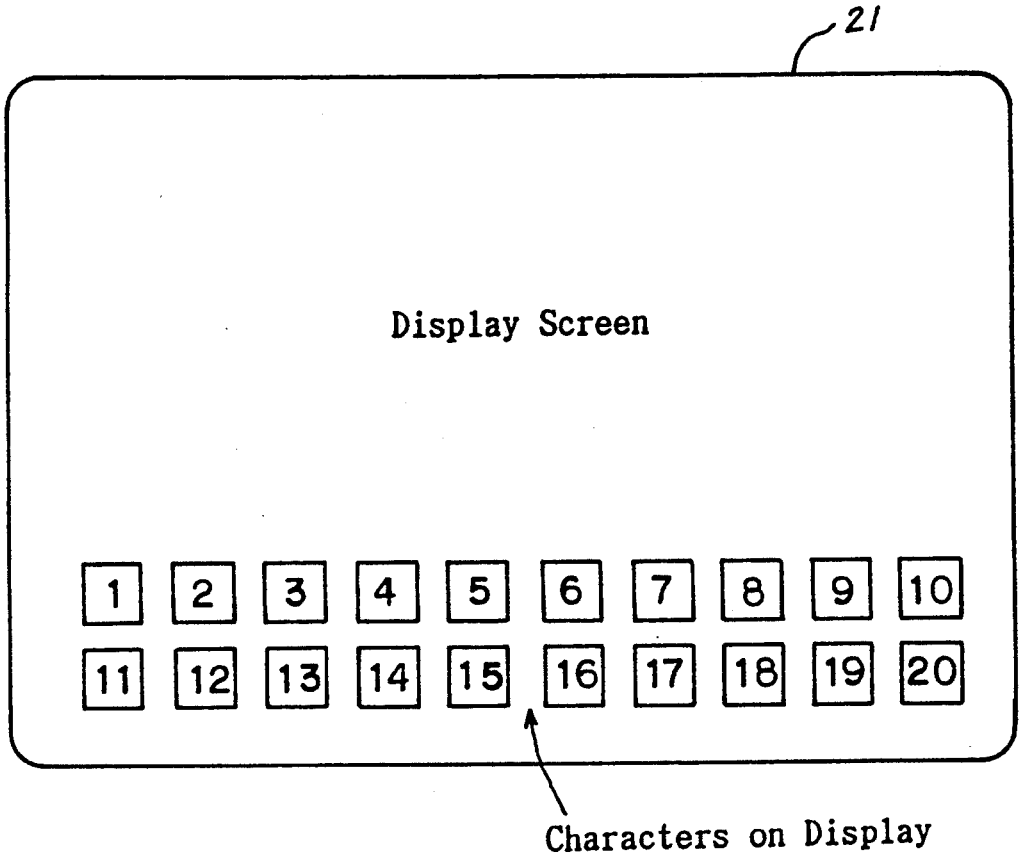
FIG. 6 is a diagram showing the character display positions on the screen of a display.

FIG. 6 shows as an example the character display positions on the screen of a display. Characters of a text are assigned to the respective positions, numbered 1 to 20, at the lower portion of the screen. Accordingly, the characters 20 in total number are displayed on the screen at a time.

To the same channel as the channel containing character codes of the memory medium or to a different channel thereof, control data other than the character codes, for example, data for controlling the memory, can be assigned. As such control data, codes not used as the character codes must be used. For example, 00*h* as an upper byte and 00*h* as a lower byte provide a memory reset command.

The command is interpreted by the microcomputer to be described below (indicated at 2 in FIG. 4), whereupon the microcomputer feeds the reset command to the memory. The address to be used at this time is of an optional value.

The character codes thus formulated into the MIDI signal format and the MIDI signal for controlling a sound source are stored in the memory medium in the form of computer signals permitting computer communication, along with a timing signal for determining when to deliver MIDI messages.

Although magnetic discs, magnetic tapes and optical discs are generally useful as memory media, also usable are other media such as semiconductor memories.

Reproduction Apparatus

Next, the reproduction apparatus for the foregoing memory medium will be described.

Figure 1:
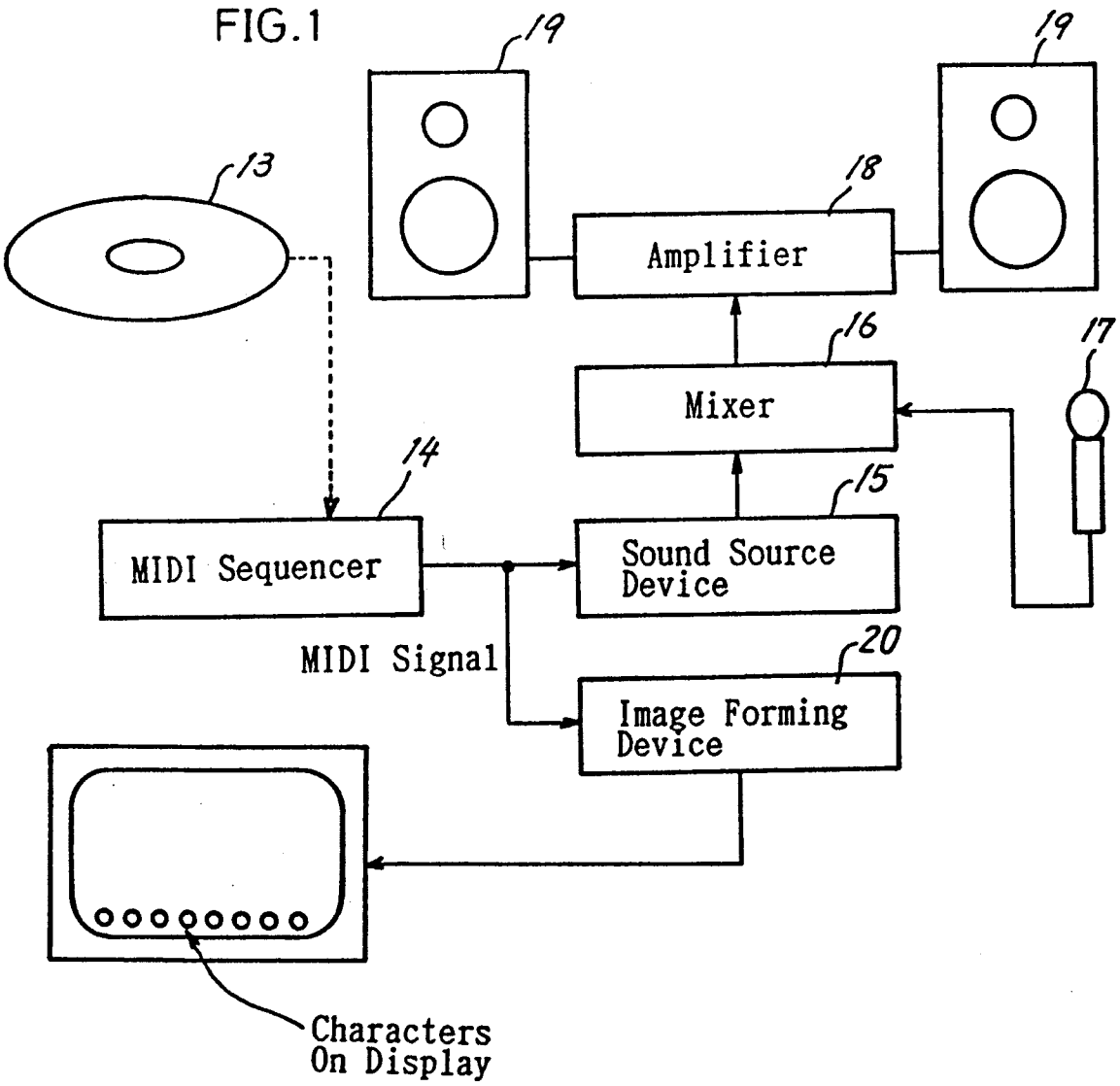
FIG. 1 is a block diagram showing a KARAOKE apparatus embodying the invention.

With the present embodiment, the memory medium is a magnetic disc 13 as shown in FIG. 1. The disc 13 has recorded in the format described MIDI signals including performance data and image data, along with the timing signal.

The signals stored in the disc 13 are read by a MIDI sequencer 14, which in turn delivers the messages of the MIDI signals serially with the timing specified by the timing signal.

The MIDI signals output from the MIDI sequencer 14 are sent to a sound source device 15 and an image forming device 20. A channel containing the performance data is registered in the sound source device 15 in advance, and a channel containing the image data in the image forming device 20. Accordingly, the sound source device 15 receives the signal containing the performance data from the channel concerned among the other MIDI signals sent forward from the MIDI sequencer 14, reads the message from the channel and produces an audio signal based on the read message.

The audio signal is sent to a mixer 16 and mixed with a song audio signal delivered from a microphone 17. The mixed signal is fed via an amplifier 18 to a pair of opposite speakers 19, 19, which release a sound.

On the other hand, the image forming device 20 receives the signal containing character codes from the channel concerned among the other MIDI signals forwarded from the MIDI sequencer 14, reads the character codes and address assigned to the note on and note off messages of the channel, prepares a text-containing image signal based on the read data and feeds the signal to a display 21. Consequently, the text of the tune concerned is shown on the screen of the display in synchronism with the audio signal.

Figure 4:
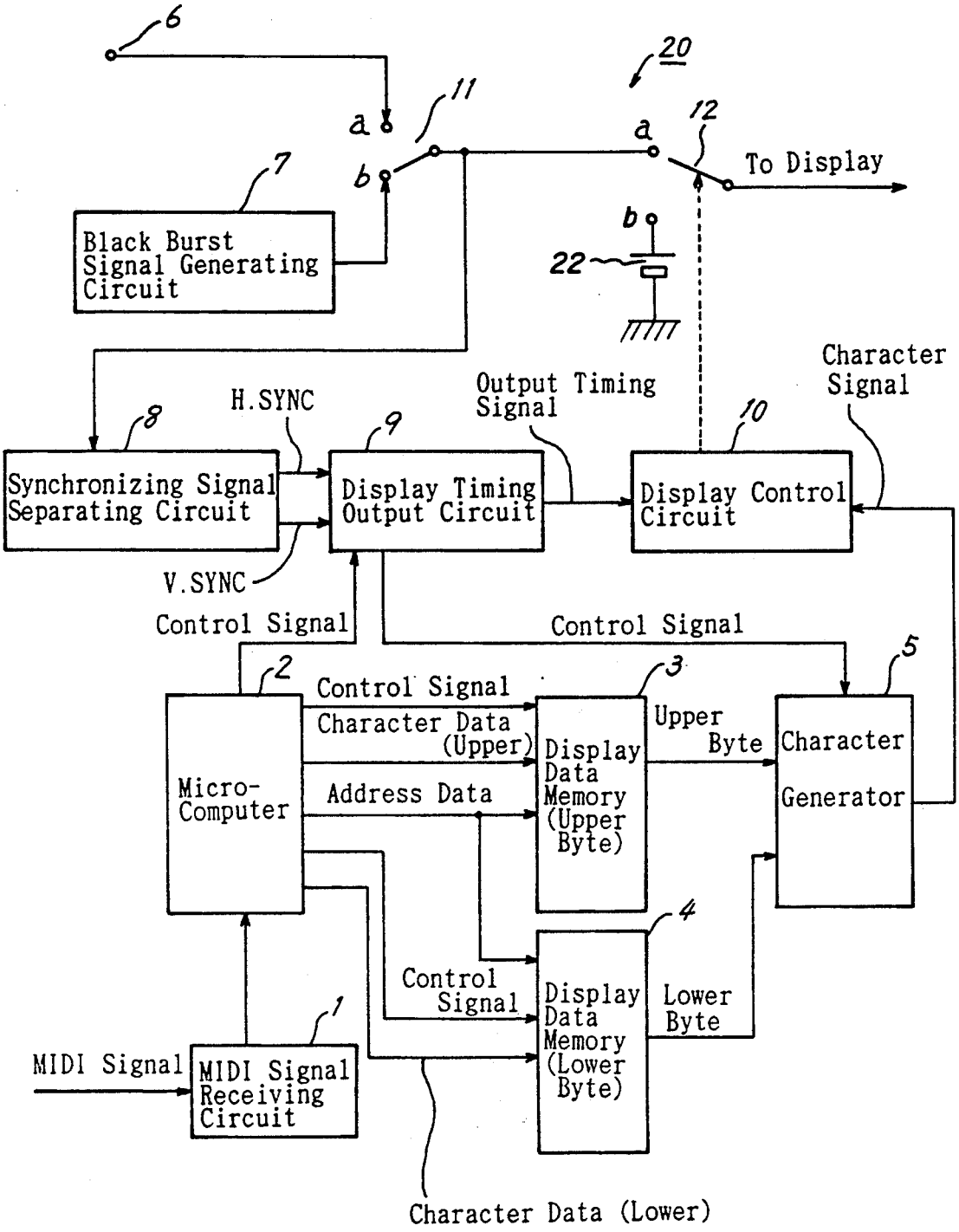
FIG. 4 is a diagram showing the construction of an image forming device.

FIG. 4 shows the circuit construction of the image forming device 20 in detail.

The MIDI signals output from the MIDI sequencer are received by a MIDI signal receiving circuit 1 and thereafter sent to a microcomputer 2, in which the channel assigned the character codes is set in advance. From among the MIDI signals forwarded from the receiving circuit 1, the computer reads the note on and note off messages of the set channel.

For setting a desired channel in the microcomputer 2, the desired channel number may be made settable using number entry keys or like input means. It is then possible to suitably change the setting even when the number of MIDI channels for controlling the sound source differs for different memory media and, accordingly, even if a different MIDI channel is to be used for character codes.

The microcomputer 2 retrieves the upper byte and lower bytes of the character codes, address and memory control data from the read note on and note off messages, and feeds these items of data to first and second display data memories 3, 4 via the corresponding output ports.

The first data memory 3 receives character code upper bytes and stores the upper bytes one after another, each at the address specified by the address data. Similarly, the second data memory 4 stores lower bytes one after another.

Figure 5:
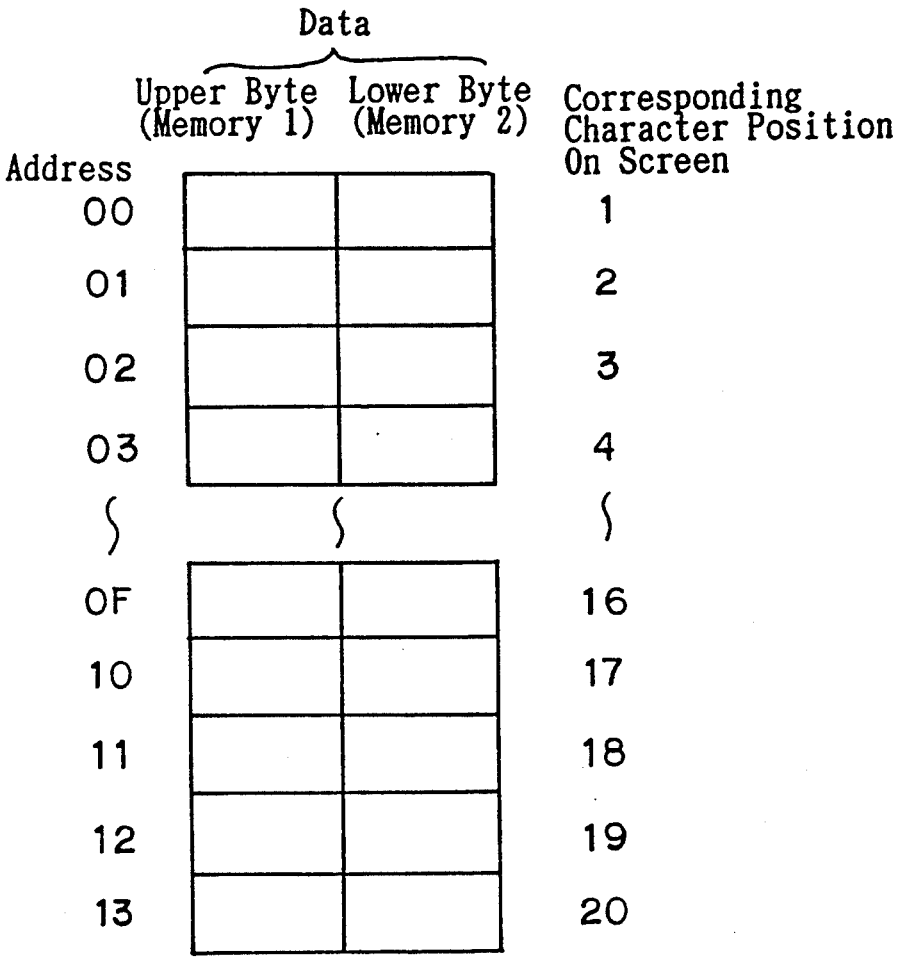
FIG. 5 is a diagram showing the relationship between character code storing addresses in memories provided in the image forming device and the corresponding character display positions on a screen.

As seen in FIG. 5, the addresses in the data memories 3, 4 are in corresponding relation with the respective display positions on the display screen. The storing address of the character code upper byte and lower byte determines the position where the corresponding character is to be displayed on the screen.

When the data memories 3, 4 receive the memory control data for resetting the memories, the memories 3, 4 are reset after delivering the written data to a character generator 5.

The character generator 5 shown in FIG. 4 has an internal memory, converts the character codes sent from the data memories 3, 4 to a character signal and feeds the character signal to a display control circuit 10 in response to a control signal given by a display timing output circuit 9.

The display control circuit 10 controls a first switch 12 based on the character signal and an output timing signal from the display timing output circuit 9 to superimpose a character on the display screen at the specified position.

More specifically, the first switch 12 has an input terminal a to which an output terminal of a second switch 11 is connected, and another input terminal b to which a white level generator 22 is connected for producing a predetermined image signal in accordance with the whiteness level of the screen. The second switch 11 has an input terminal a to which a terminal 6 is connected for receiving an image signal from a video disc player or like external image device. The switch 11 has another input terminal b to which a black burst signal generating circuit 7 is connected for producing a monochromatic background picture of black or blue. The second switch 11 is selectively closed at either one of the input terminals as desired by the user.

When the screen portion other than the portion where characters are superimposed is used for display, the first switch 12 is closed at the terminal a, so that the external image signal from the terminal 6 or a black burst signal from the circuit 7 is fed to the display. While the superimposition area at the bottom of the screen is horizontally scanned, the first switch 12 is changed over from the terminal a to the terminal b for a length of time corresponding to the thickness of characters in response to the control signal from the display control circuit 10, whereby the characters are superposed at the white level on the screen.

Figure 6A:
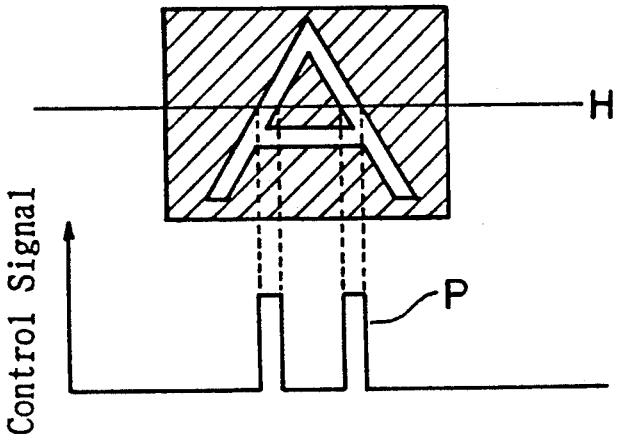
FIG. 6A is a diagram illustrating the principle for superimposing characters.
Figure 7:
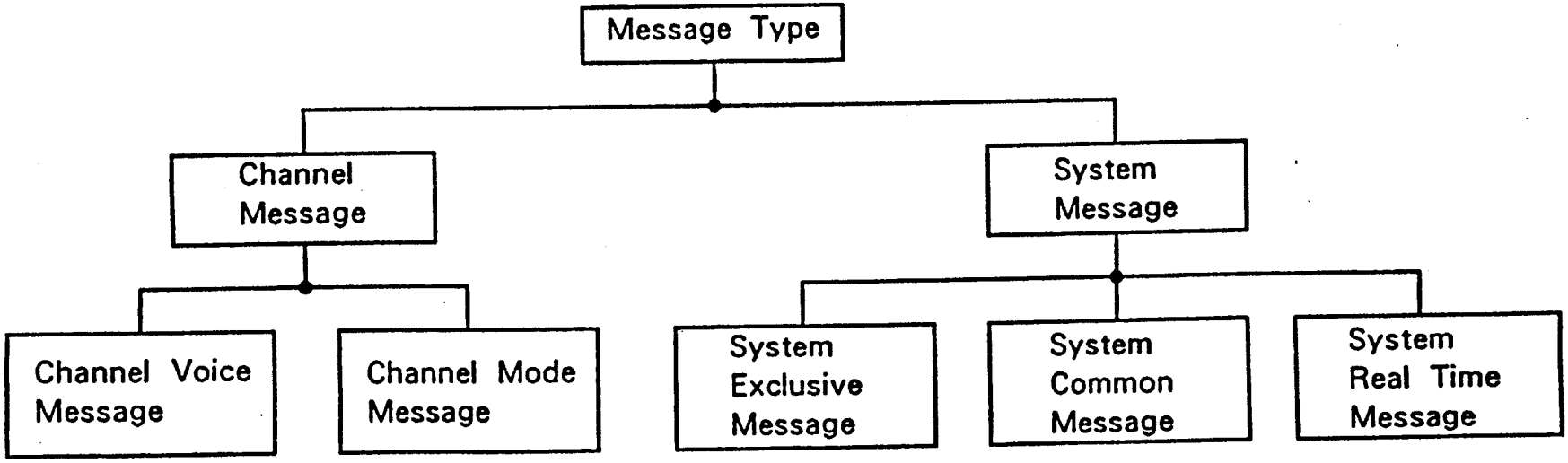
FIG. 7 PRIOR ART
FIG. 7 is a diagram showing different types of MIDI messages.

FIG. 6A shows how "A" of the alphabet is superimposed on the screen. Pulses P as illustrated are fed as the control signal to the first switch 12 to change over the switch to the terminal b to apply the white level image signal to the image signal on a horizontal scan line H.

At this time, the display timing output circuit 9 shown in FIG. 4 calculates the display position of each character on the screen from a horizontal synchronizing signal (H. SYNC) and a vertical synchronizing signal (V. SYNC) from a synchronizing signal separating circuit 8 to prepare an output timing signal and feeds the signal to the display control circuit 10.

In this way, a text is shown on the display 21 of FIG. 1, as superimposed thereon and synchronized with the accompaniment.

Although one embodiment of the present invention has been described above, the invention is not limited to this embodiment but can be modified variously. For example, the characters of given size are displayed in a fixed position according to the foregoing embodiment, whereas the position and the size are variable as desired by assigning the memory control data signals for controlling the display position and size of characters.

Further if different items of character data are stored in different MIDI channels, desired character data can be reproduced by changing the channel during reproduction. For example, a first channel may be assigned a Japanese text, with a second channel assigned an English text. One of the Japanese and English texts can then be selected as required.

The character codes assigned to the note on and note off messages on MIDI signal according to the foregoing embodiment may alternatively be assigned to other messages. For example, the character codes can be assigned to exclusive messages for which a an optional format can be determined as required.

Further if the character generator described is replaced by a circuit for outputting graphic presentations corresponding to the code input, not only characters but graphic presentations can be displayed.

According to the invention described above, performance data and image data can be stored in memory media with use of a greatly reduced amount of data. This gives an increased period of reproduction to memory media of a given capacity. The invention is therefore useful especially for KARAOKE apparatus.

Moreover, the performance data and the image data can be readily retrieved from the memory media using a conventional MIDI sequence as it is without any modification. This serves to simplify the apparatus in construction.

What is claimed is:

1. A data recording system comprising:

a memory medium having MIDI signal channels, means for assigning performance data of a song to at least one of the MIDI signal channels, and means for assigning word data corresponding to the lyrics of the song to at least one of the other MIDI signal channels according to MIDI standard, and means for storing the assigned performance data and the assigned word data in the memory medium.

2. A data recording system as defined in claim 1, wherein the storing means is for further storing, along with the word data, address data corresponding to a position on a screen where the word data is to be displayed, in the at least one channel containing the word data.

3. A data recording system as defined in claim 1, wherein the storing means is for further storing together with MIDI signals containing the performance data and the word data, a timing signal for controlling a timing with which said performance data and said word data are to be reproduced.

4. A reproduction apparatus for reproducing performance data of a song and word data corresponding to the lyrics of the song from a memory medium having MIDI signal channels, the performance data being assigned to at least one of the MIDI signal channels, and the word data being assigned to at least one of the other MIDI signal channels according to MIDI standard, the apparatus comprising:

signal reading means for reading MIDI signals from the memory medium, a sound source device connected to an output terminal of the signal reading means for receiving one of the read signals from a MIDI signal channel containing performance data to produce an audio signal based on the performance data, sound release means for releasing performance sound based on the audio signal output from the sound source device, an image forming device connected to the output terminal of the signal reading means for receiving another one of the read signals from a MIDI signal channel containing word data to produce a video signal based on the word data, and display means for displaying an image based on the video signal output from the image forming device.

5. A reproduction apparatus as defined in claim 4 wherein a mixer is provided between the sound source device and sound release means for mixing together the audio signal output from the sound source device and an audio signal from a microphone.

6. A reproduction apparatus as defined in claim 4 wherein the signal reading means has a MIDI sequencer for reading a timing signal from the memory medium along with the MIDI signals containing the performance data and the word data and feeding the MIDI signals to the sound source device and the image forming device with timing in accordance with the timing signal.

* * * * *